United States Patent [19]

Kirkling

[11] Patent Number: 4,920,912

[45] Date of Patent: May 1, 1990

[54] TIME DIAL FOR PHARMACEUTICAL CONTAINERS

[76] Inventor: William C. Kirkling, 601 E. 32nd St., Chicago, Ill. 60616

[21] Appl. No.: 166,555

[22] Filed: Mar. 10, 1988

[51] Int. Cl.[5] ..... G09F 9/40

[52] U.S. Cl. ..... 116/308; 116/309; 206/534

[58] Field of Search ..... 116/308, 309; 206/534, 206/459; 215/201, 203, 206; 40/492, 495

[56] References Cited

U.S. PATENT DOCUMENTS

| | | | |
|---|---|---|---|
| 623,171 | 4/1899 | Mowry | 116/308 |
| 2,450,949 | 10/1948 | Gattliccio et al. | 116/308 |
| 2,587,147 | 2/1952 | Guion et al. | 116/308 |
| 2,767,680 | 10/1956 | Lerner | 116/308 |
| 2,953,242 | 9/1960 | Shaw | 206/534 |
| 3,446,179 | 5/1969 | Bender | 206/534 |
| 3,739,740 | 6/1973 | Fromer | 116/308 |
| 3,960,713 | 6/1976 | Carey | 116/308 |
| 4,405,045 | 9/1983 | Villa Real | 206/534 |
| 4,501,370 | 2/1985 | Kelley | 116/308 |
| 4,705,182 | 11/1987 | Newel-Lewis | 116/308 |

*Primary Examiner*—William A. Cuchlinski, Jr.
*Assistant Examiner*—Thomas B. Will

[57] ABSTRACT

A time dial for a pharmaceutical container, preferably the container cap, is disclosed. The time dial comprises a disk rotatably mounted on the top surface of the cap; a window in the disk; and a plurality of numerals representing hours arranged in a ring on the top surface of the cap, underlying the disk, whereby rotation of the disk causes a select numeral to appear through the window.

5 Claims; 1 Drawing Sheet

TIME DIAL FOR PHARMACEUTICAL CONTAINERS

BACKGROUND OF THE INVENTION

This invention related generally to time dials for containers, especially pharmaceutical container or bottle caps.

Most pharmaceuticals, prescription and over-the-counter, are prescribed to be taken at certain time intervals, for example, every four hours. Accordingly, the person taking the medication must keep track of the time when the medication was taken and/or the time for the next dosage. However, people commonly forget whether or when they last took their medication. This problem is more common along individuals having several prescriptions and among the elderly.

Accordingly, it would be desirable to have a mechanism for indicating the time when medication was last taken, and the time for taking the next dosage.

OBJECTS OF THE INVENTION

It is an object of this invention to provide a time dial for indicating the time when medication was last taken.

It is also an object of the invention to provide a time dial that indicates both when medication was last taken and when medication should be taken next.

It is a further object of the invention to provide a time dial that is attached directly to a pharmaceutical container or bottle, so that there can be no mistake as to what drug was taken when, and so that the dial will not be lost or misplaced.

Finally, it is an object of the invention to provide a time dial that is easy to use and inexpensive to manufacture.

SUMMARY OF THE INVENTION

In its most basic embodiment, the time dial of the invention is attached to a pharmaceutical container, and comprises a moveable member, and a plurality of time marks on either the moveable member or the container, whereby the member may be moved to indicate a select one of the time marks. The moveable member may be a circular disk rotatably mounted to the top surface of the container cap or bottom surface of the container base, or may be a cylindrical sleeve rotatably mounted to the cylindrical side walls of the container cap or base. Other variations may readily appear, and are within the scope of the invention. The time marks, preferably numerals representing hours, may be placed on the moveable member or on the container. For example, the disk referred to above may have a plurality of numerals about its outer periphery and the container may be provided with a stationary indicator, whereby rotation of the disk will cause a selected number on the disk to align with the stationary indicator on the container. Alternatively, the numbers may be applied to the container, and the disk may be provided with an indicator, so that rotation of the disk will again cause the indicator to align with a select number. The number so indicated may refer to either the hour when medication was taken, or the hour when medication should next be taken. In either event, the time dial of the invention provides a simple, easy to use mechanism for indicating the appropriate time. Further features of the invention are disclosed below in reference to three preferred embodiments.

In one preferred embodiment, the moveable member is a disk rotatably mounted to the top surface of the container cap, the disk having a window therein; and the time marks comprise numbers applied to the cap, underlying the disk, in a ring—like a clock face—whereby the disk may be rotated so that a select one of the numbers appears through the window. In addition, the disk is provided with a handle to facilitate rotation of the disk. The principal advantage of this embodiment is its simplicity. The person taking medicine simply sets the disk to the number corresponding to the hour when medication was taken. The dial may be consulted later to confirm when medication was last taken. Only one number appears through the window—the disk covers the other numbers—so that potential problems of misreading the dial are eliminated. Furthermore, this embodiment may be used for any prescribed intervals for taking medication.

In a second preferred embodiment, the numbers are placed on the cylindrical side walls of the pharmaceutical container cap. The moveable member comprises a cylindrical sleeve rotatably attached to the side walls of the cap overlying the numbers. The ring has a window therein so that a select one of the numbers may appear therethrough. As with the first preferred embodiment, the ring may be rotated to expose a single number, representing the time when medication was taken.

A third embodiment is disclosed which indicates the time when medication was last taken, and in addition, indicates the time when medication should next be taken. The time dial comprises two series of numbers applied to the top surface of the cap, each series arranged in concentric rings. A disk is pivotally mounted to the top surface of the cap overlying the two series of numbers. Two windows are provided in the disk. A first window is positioned to expose a select one of the first series or outer ring of numbers. A second window exposes a corresponding number in the second or inner row of numbers. The disk is also provided with a handle to facilitate rotation of the disk. Preferably, the numbers in the outer ring represent when medication was taken, and the numbers in the inner ring represent the time when medication should next be taken, based on the prescribed interval, for example, every four hours. Accordingly, a person may rotate the disk to expose in the outer window the time when medication was taken. Automatically, the inner window will display the time when medication should next be taken.

Further objects and advantages of the invention will become apparent from the following detailed description, as read in connection with the accompanying drawings.

DETAILED DESCRIPTION

Figure 1:
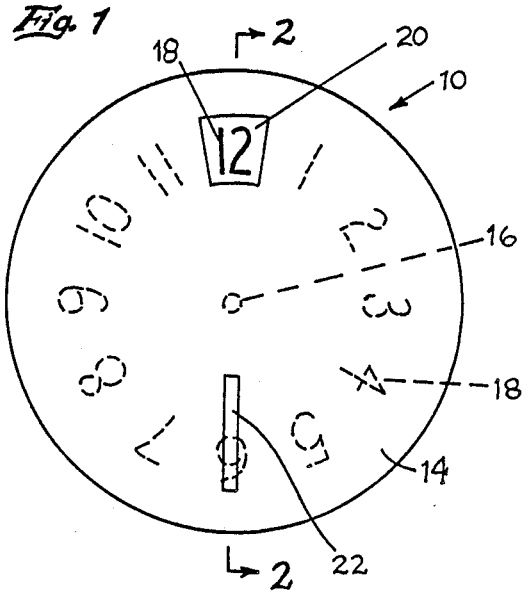
FIG. 1 is a top plan view of a first embodiment of the time dial of the invention attached to a pharmaceutical container cap.
Figure 2:
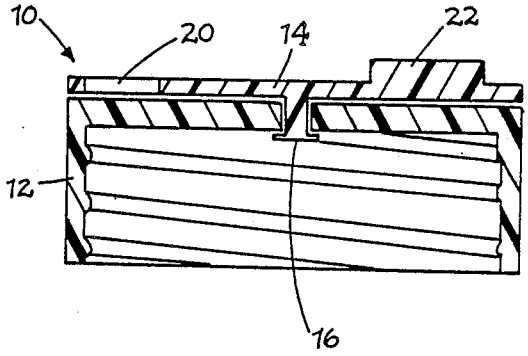
FIG. 2 is a cross-sectional view of the first embodiment of the time dial of the invention taken along line 2—2 of FIG. 1.

Referring to the drawings, FIGS. 1 and 2, the first embodiment of the invention comprises a time dial 10 mounted on pharmaceutical cap 12. The time dial 10 comprises a disk 14 pivotally mounted at 16 to cap 12, and a series of time marks 18. Although pivotal mounting 16 is shown, other means for rotatably attaching the disk 14 to the cap 12 are well known and within the scope of the invention. The disk 14 is provided with a window 20 and a handle 22. The window is preferably formed by molding an opening in the disk 14. The handle 22 is preferably integrally molded to the disk 14. The time marks 18 may be molded into the cap 12, painted onto the cap 12, or printed on a separate plate or adhesive backed label and fastened to the cap 12. The time marks 18 preferably comprise a series of arabic numerals 1 through 12 arranged in a ring about the outer periphery of the cap 12, concentric with pivotal mounting 16, like the numbers on a clock face. It is readily apparent, however, that other forms of time marks, or more or less than twelve marks may be used. The ring of time marks 18 have the same radius from the pivot 16 as the window 20 so that each time mark 18 may be exposed through the window 20.

Figure 3:
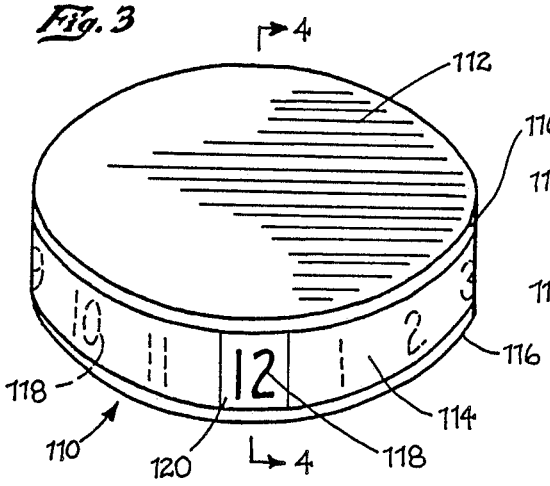
FIG. 3 is a perspective view of a second embodiment of the time dial of the invention attached to a pharmaceutical container cap.
Figure 4:
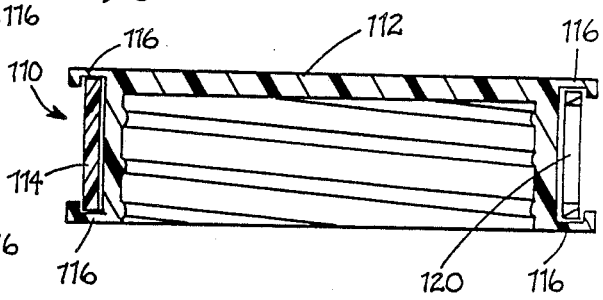
FIG. 4 is a cross-sectional view of a second embodiment of the invention taken along line 4—4 of FIG. 3.

Alternatively, a time dial 110 may be mounted on the side walls of a pharmaceutical cap 112, as shown in the second embodiment illustrated in FIGS. 3 and 4. The time dial 110 comprises a cylindrical sleeve 114 mounted to the side walls of cap 112 and a series of time marks 118. The sleeve 114 may be mounted in any conventional manner, channel portions 116 integral with cap 112 being illustrated. Sleeve 114 is provided with a window 120. As with the first embodiment, the window 120 is aligned with the time marks 118 so that any selected time mark may be exposed through window 120.

The operation of the first two embodiments are substantially the same. The moveable member (disk 14, sleeve 114) is rotated to reveal through window (20, 120), the time mark (18, 118) that corresponds to the hour when medication was taken, for example, "12" for 12:00 noon. Any time thereafter the time dial (10, 110) may be consulted to verify when medication was last taken. When the prescribed time interval between dosages (e.g., four hours) has elapsed, medication is again taken, and the time dial is then rotated to the new time, for example, "4" for 4:00 PM. The process then continues throughout the day.

Figure 5:
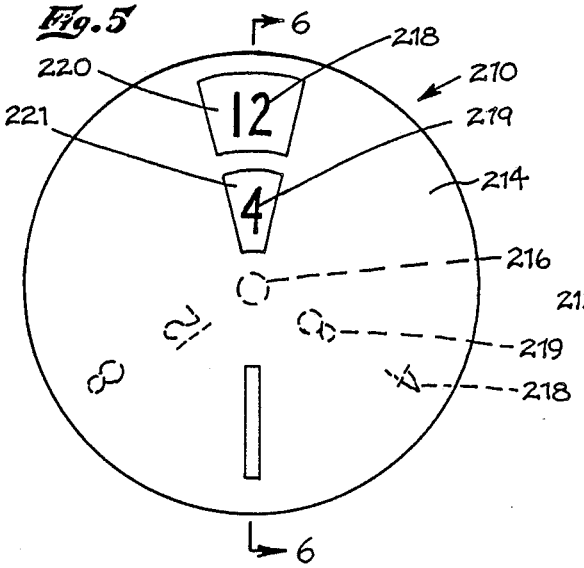
FIG. 5 is a top plan view of a third embodiment of the invention, illustrating plural time indicators.
Figure 6:
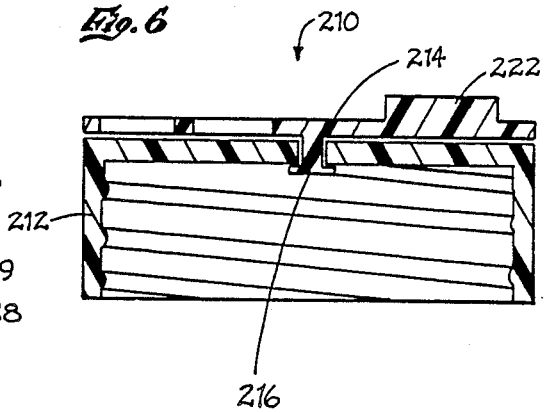
FIG. 6 is a cross-sectional view of the third embodiment of the invention taken along line 6—6 of FIG. 5.

A third embodiment of the time dial of the invention is illustrated in FIGS. 5 and 6. The time dial 210 comprises a disk 214 pivotally mounted at 216 to cap 212, and two rings of time marks 218 and 219. The disk 214 is provided with two windows 220 and 221, and a handle 222. The two rings of time marks 218 and 219 may be imprinted directly on the top surface of the cap 212 or may be imprinted on a separate plate or an adhesive backed paper fastened to the cap 212. Both time mark rings 218 and 219 are concentric about the pivot 216. The outer ring of time marks 218 preferably indicates the hour when medication was taken. The inner ring of time marks 219 are preselected to correspond to the hour when medication is to be taken next, based upon a prescribed interval between dosages. The time dial illustrated in FIG. 5 shows a four hour interval. As is readily apparent, different intervals may be selected. There are several ways to define the relationship between the outer and inner rings, however. As shown in FIG. 5, the numbers in the outer ring 218 are positioned like a conventional clock face, albeit with only three numbers being used; the windows 220 and 221 are radially spaced from one another; and the numbers in the inner ring 219 are preselected to make the desired four hour time interval relationship. Alternatively, the numbers in both the outer 218 and inner 219 rings may be positioned like a conventional clock face, and the inner window 221 may then be staggered clockwise four positions to achieve the desired four hour interval relationship.

Time dial 210 is operated by rotating the disk 214 so that the hour when medication was taken appears in the outer window 220, for example, 12:00 noon. The inner window 221 displays the next time for medication to be taken, example, 4:00 PM. When 4:00 PM arrives, medication is again taken, and the disk 214 is rotated by means of handle 222 until "4" appears in the outer window 220. Again, the inner window 221 will display the next time for medication to be taken, example, 8:00 PM.

The time dial of the invention is preferably made from the same material as the pharmaceutical container cap, most commonly, injected molded plastic. The time marks may be formed by molding the same directly into the cap, raised or recessed. Alternatively, the marks may be painted on the cap, or may be printed onto an adhesive backed sticker which is applied to the cap. A window within the moveable member has been illustrated in each embodiment as an indicator. This is preferable because the member covers the remaining time marks eliminating potential misreading. However, other indicators could be used in place of a window, for example, a pointer or a simple mark.

While the preferred embodiments of the time dial of the invention are shown as being rotatably attached to a container cap, the time dial of the invention may be adapted to be rotatably attached to a container base. For example, the first and third embodiments may be attached to the bottom surface of a container base. The second embodiment may be attached to cylindrical side walls of a container base.

While three embodiments of the invention have been shown and described herein, it is to be appreciated that various changes, rearrangements and modifications may be made thereto without departing from the scope of the invention as defined by the following claims.

What is claimed is:

1. A time dial for a pharmaceutical container cap, comprising:
   (a) a member rotatably attached to said cap;
   (b) a first indicator on one of said member or said cap;
   (c) a first plurality of time marks representing hours on the other of said member or said cap, whereby rotation of said member aligns said first indicator with a select one of said first time marks;
   (d) a second indicator on said one of said member or said cap, spaced from said first indicator; and
   (e) a second plurality of time marks on said other of said member or said cap, whereby said rotation of said member aligns said second indicator with one of said second time marks the difference between said select one of said first time marks and said one of said second time marks representing a predetermined time interval.

2. A time dial as in claim 1, wherein said first and said second time marks are on the top surface of said cap, said member comprising a disk rotatably attached to said cap, said disk overlying said first and said second time marks, and said first and said second indicators comprising windows in said disk.

3. A time dial as in claim 1, further comprising a handle integral with said member for rotating said member.

4. A time dial for a cylindrical pharmaceutical container cap, the cap having a circular top surface, comprising:

(a) a disk rotatably mounted to the circular top of the pharmaceutical container cap;

(b) a first window in said disk, adjacent the outer periphery of said disk;

(c) a second window in said disk, said second window radially spaced from said first window;

(d) a first plurality of spaced time marks attached to the circular top surface of the cap, said first plurality of spaced time marks positioned in a ring adjacent the outer periphery of the cap and positioned so that a select first time mark may be exposed through said first window;

(e) a second plurality of spaced time marks attached to the circular top surface of the cap, said second plurality of spaced time marks positioned in a ring spaced from and concentric with said first plurality of time marks and positioned so that a selected second time mark may be exposed through said second window, the time marks of said second plurality of time marks representing a predetermined time interval from the adjacent, radially spaced time marks of said first plurality of time marks; and (f) a handle integral with said disk for rotating said disk with respect to said cap without rotating the cap on the container.

5. A time dial as in claim 4, wherein the time marks of said second plurality of spaced time marks are on an adhesive backed paper which is attached to said top surface of the cap.

* * * * *